US008911337B2

(12) United States Patent
Bukovitz

(10) Patent No.: US 8,911,337 B2
(45) Date of Patent: Dec. 16, 2014

(54) ROLLER COVER SUPPORT ASSEMBLY WITH ROLLER COVER RETENTION SPRING

(75) Inventor: Richard K. Bukovitz, Orrville, OH (US)

(73) Assignee: The Wooster Brush Company, Wooster, OH (US)

( * ) Notice: Subject to any disclaimer, the term of this patent is extended or adjusted under 35 U.S.C. 154(b) by 2223 days.

(21) Appl. No.: 11/855,273

(22) Filed: Sep. 14, 2007

(65) Prior Publication Data

US 2009/0075797 A1 Mar. 19, 2009

(51) Int. Cl.
*B05C 17/02* (2006.01)

(52) U.S. Cl.
CPC ..... *B05C 17/02* (2013.01)
USPC ..... 492/17; 492/16; 492/19

(58) Field of Classification Search
USPC ..... 492/16, 17, 19
See application file for complete search history.

(56) References Cited

U.S. PATENT DOCUMENTS

| | | | | |
|---|---|---|---|---|
| 2,970,366 | A | 2/1961 | Gill | |
| 2,977,671 | A | 4/1961 | Wiegand | |
| 2,987,746 | A | 6/1961 | Davis et al. | |
| 3,060,555 | A * | 10/1962 | Kirshenbaum et al. | 492/19 |
| 3,102,327 | A * | 9/1963 | Wiegand | 492/19 |
| 3,259,383 | A * | 7/1966 | Johnson et al. | 267/161 |
| 3,447,184 | A | 6/1969 | McGinley | |
| 3,751,748 | A | 8/1973 | Roe et al. | |
| 3,986,226 | A | 10/1976 | Roe et al. | |
| 4,209,883 | A | 7/1980 | Hawk | |
| 4,316,301 | A | 2/1982 | Smith et al. | |
| 4,897,893 | A | 2/1990 | Barker | |
| 5,345,648 | A * | 9/1994 | Graves | 15/230.11 |
| 5,490,303 | A | 2/1996 | Graves | |
| 5,584,092 | A | 12/1996 | Polzin et al. | |
| 5,619,769 | A | 4/1997 | Hutt | |
| 6,101,662 | A | 8/2000 | Polzin et al. | |
| 6,510,579 | B1 * | 1/2003 | Gartner | 15/230.11 |
| 7,028,365 | B2 | 4/2006 | Martin et al. | |
| 2006/0143918 | A1 | 7/2006 | Martin et al. | |

* cited by examiner

*Primary Examiner* — Christopher Besler
(74) *Attorney, Agent, or Firm* — Renner, Otto, Boisselle & Sklar, LLP

(57) ABSTRACT

A roller cover support assembly includes a roller cover support mountable for rotation on a roller frame shaft and a resiliently deformable annular retention spring including a plurality of circumferentially spaced convex arcs having peaks engageable with the inner diameter of a roller cover when forced over the retention spring for frictionally retaining the roller cover on the roller cover support. These peaks may have an axial length for increasing the frictional contact between the convex arcs and inner diameter of the roller cover when forced over the retention spring and inwardly tapered outboard ends for ease of forcing the roller cover over the retention spring. The convex arcs may be interconnected by concave arcs between the convex arcs at respective tangent points of the arcs.

16 Claims, 2 Drawing Sheets

ROLLER COVER SUPPORT ASSEMBLY WITH ROLLER COVER RETENTION SPRING

FIELD OF THE INVENTION

This invention relates to a roller cover support assembly including a roller cover support and roller cover retention spring for securely fastening a roller cover to the roller cover support while painting and still allowing the roller cover to be quickly and easily removed therefrom for ease of cleaning of the roller cover support and replacement of the roller cover after use.

BACKGROUND OF THE INVENTION

There are many different known types of roller cover support assemblies that permit the removal and replacement of roller covers with varying degrees of difficulty. One such roller cover support assembly that allows for the easy assembly and removal of a roller cover from a roller cover support and yet positively and securely retains the roller cover in place during use is disclosed in U.S. Pat. No. 5,490,303, assigned to the same assignee as the present application. The roller cover support disclosed in that patent includes a retention spring having a Belleville type spring washer portion and a plurality of circumferentially spaced apart spring fingers extending radially and axially outwardly from the outer periphery of the washer portion. The deflection of the spring washer portion permits the length of the spring fingers to be relatively short to minimize possible areas of entrapment of paint both under the spring fingers and inside the associated supporting structure and still achieve the necessary overall deflection of the spring fingers to retain the normal range of tolerances of roller covers on the roller cover support.

SUMMARY OF THE INVENTION

The present invention relates to a roller cover support assembly that uses a unique retention spring for frictionally retaining the roller cover on the roller cover support.

In accordance with one aspect of the invention, the retention spring is a resiliently deformable annular spring that is coupled to the roller cover support and includes a plurality of circumferentially spaced convex arcs having peaks engageable with the inner diameter of a roller cover when forced over the retention spring for frictionally retaining the roller cover on the roller cover support.

In accordance with another aspect of the invention, the peaks of the convex arcs have an axial length for establishing frictional contact with a roller cover when forced over the retention spring.

In accordance with another aspect of the invention, the convex arcs have inwardly tapered outboard ends for ease of forcing the roller cover over the retention spring.

In accordance with another aspect of the invention, the convex arcs are interconnected by concave arcs between the convex arcs.

In accordance with another aspect of the invention, the convex and concave arcs are connected together at respective tangent points of the arcs.

In accordance with another aspect of the invention, the roller cover support includes a pair of axially spaced annular surfaces adjacent the outboard end of the roller cover support between which the retention spring is captured.

In accordance with another aspect of the invention, the retention spring has an overall length somewhat less than the axial spacing between the annular surfaces allowing some axial movement of the retention spring between the annular surfaces.

In accordance with another aspect of the invention, an inboard end cap is attached to a reduced diameter end portion at the inboard end of the roller cover support for trapping the retention spring between the inboard end cap and a larger diameter portion of the roller cover support adjacent the reduced diameter end portion.

In accordance with another aspect of the invention, the inboard end cap may have an annular shoulder extending radially outwardly beyond the roller cover support to provide a stop for locating the roller cover on the roller cover support when the roller cover is fully inserted thereon.

These and other aspects, features and advantages of the present invention will become apparent as the following description proceeds.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but several of the various ways in which the principles of the invention may be employed.

BRIEF DESCRIPTION OF THE DRAWINGS

The present invention may be more readily understood by reference to the following drawings in which.

DETAILED DESCRIPTION OF THE INVENTION

Figure 1:
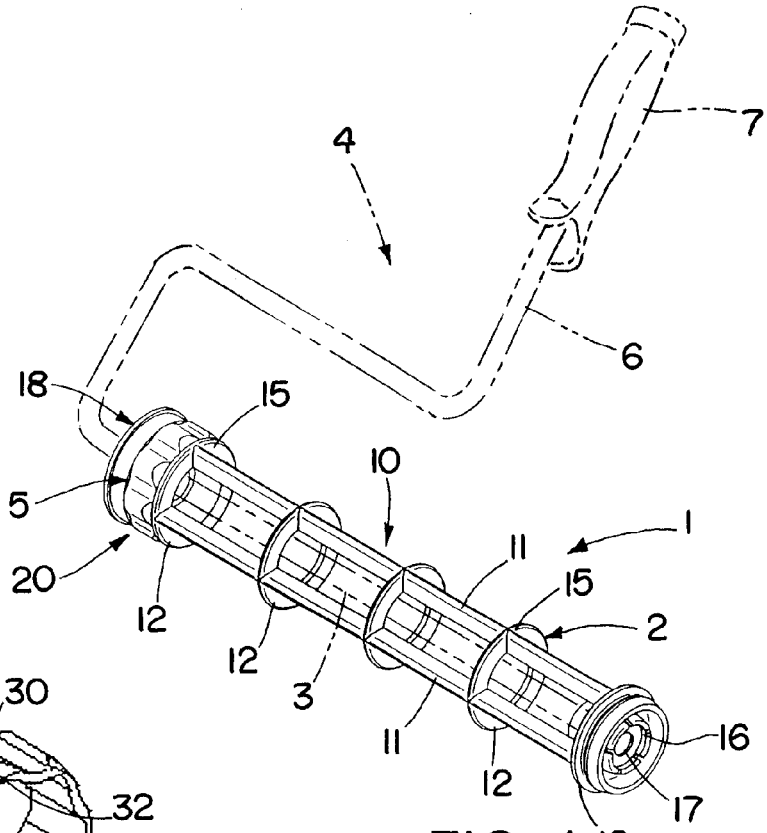
FIG. 1 is a perspective view of one form of roller cover support assembly of the present invention.
Figure 2:
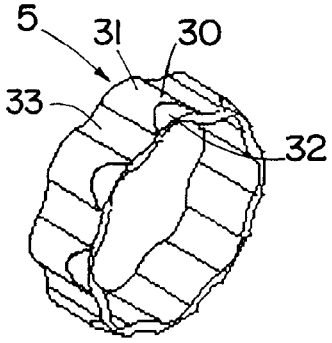
FIG. 2 is an enlarged perspective view of the retention spring of the roller cover support assembly of FIG. 1.
Figure 3:
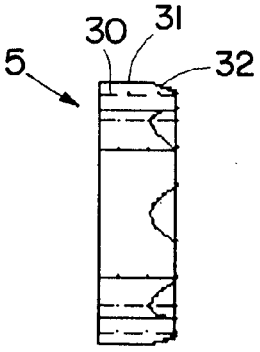
FIG. 3 is a side elevation view of the retention spring of FIG. 2.
Figure 4:
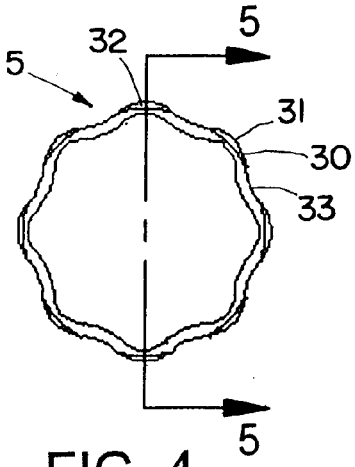
FIG. 4 is an end elevation view of the retention spring of FIG. 3 as seen from the right end thereof.
Figure 5:
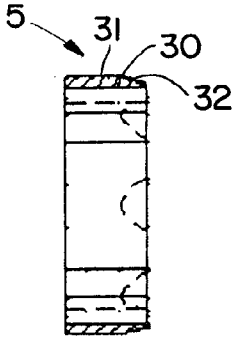
FIG. 5 is a longitudinal section through the retention spring of FIG. 4, taken along the plane of the line 5-5 thereof.

Referring now in detail to the drawings, wherein the same reference numbers are used to designate like parts, and initially to FIG. 1, there is shown one form of roller cover support assembly 1 of the present invention including a roller cover support 2 mounted for rotation on the shaft portion 3 of a roller frame 4 (shown in phantom lines in FIG. 1), and a resiliently deformable annular retention spring 5 for frictionally retaining a roller cover (not shown) on the roller cover support as described hereafter. Roller frame 4 may be made from a heavy gauge wire or rod bent to shape to provide the shaft portion 3 on which the roller cover support 2 is rotatably mounted and a handle portion 6 to which a hand grip 7 may be attached to facilitate grasping of the roller frame with one hand. A threaded socket (not shown) may be provided in the outer end of hand grip 7 to facilitate attachment of an extension pole or the like.

Roller cover support 2 may be a substantially rigid cage body 10 generally of the type disclosed in U.S. Pat. No. 5,490,303, the entire disclosure of which is incorporated herein by reference. Such cage body 10 may be injection molded out of a suitable plastic material and may comprise a plurality of circumferentially spaced, longitudinally extending roller cover support bars 11 joined together at a plurality of axially spaced locations by arcuate ribs 12 extending between the support bars. The height of ribs 12 may substantially correspond to the height of bars 11, and where joined to the bars, may form axially spaced annular rings 15 each having an outer diameter slightly less than the inner diameter of the roller cover to be supported thereby.

At the outboard end of roller cover support 2 is a central hub portion 16 which may have an axial opening 17 therethrough in which a bushing (not shown) may be press fitted for rotatably receiving shaft portion 3. Cage body 10 may otherwise be substantially open throughout its length except for end caps which may be mounted at opposite ends thereof to prevent paint from getting inside the roller cover. Only the inboard end cap 18 is shown.

Figure 6:
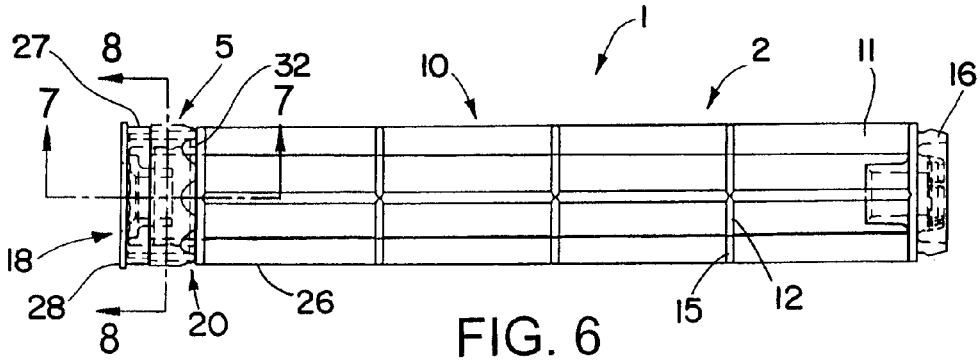
FIG. 6 is a side elevation view of the roller cover support assembly of FIG. 1.
Figure 7:
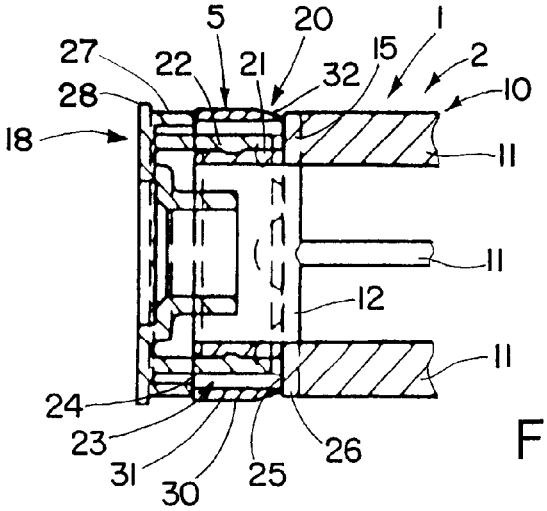
FIG. 7 is an enlarged fragmentary longitudinal section through the roller cover support assembly of FIG. 6, taken along the plane of the line 7-7.
Figure 8:
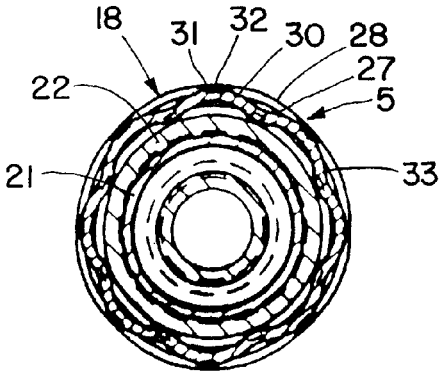
FIG. 8 is an enlarged transverse section through the roller cover support assembly of FIG. 6, taken along the plane of the line 8-8.

Referring further to FIG. 1 and also to FIGS. 6-8, retention spring 5, which is preferably made of a suitable resiliently deformable plastic such as acetal, is suitably coupled to the inboard end 20 of roller cover support 2. To that end, a reduced diameter end portion 21 (see FIG. 7) is provided at the inboard end to which an annular sleeve portion 22 of the inboard end cap 18 may be snap fitted for trapping the retention spring in an axial space 23 formed between two annular surfaces 24 and 25 of the inboard end cap and larger diameter portion 26 of the roller cover support adjacent the reduced diameter end portion. Retention spring 5 has an overall length somewhat less than the axial space 23 between such annular surfaces 24 and 25 allowing for some axial movement of the retention spring therebetween.

Extending radially outwardly beyond the inboardmost end of larger diameter portion 27 of the inboard end cap over which the roller cover extends when forced over the retention spring is an annular shoulder 28 which acts as a stop for locating the roller cover on the roller cover support when fully inserted thereon.

As shown in greater detail in FIGS. 2-5, retention spring 5 extends over a full 360° arc and includes a plurality of circumferentially spaced resiliently deformable transversely convex arcs 30 each having peaks 31 engageable with the inner diameter of a roller cover when forced over the retention spring for frictionally retaining the roller cover on the roller cover support. These peaks 31 have an axial length corresponding to a substantial majority of the axial length of the retention spring. Preferably the peaks 31 have an axial length of about 0.300 inch to about 0.400 inch and more preferably about 0.330 inch and have substantillay the same outer radius throughout a substantial majority of their length for increasing the frictional contact between the convex arcs and the inner diameter of the roller cover when forced over the retention spring. Also the convex arcs have axially inwardly tapered outboard ends 32 which preferably have an axial length of about 0.100 inch to about 0.200 inch and more preferably about 0.150 inch providing the retention spring with an overall length preferably of about 0.400 inch to about 0.600 inch and more preferably about 0.480 inch. Also the tapered outboard ends of the convex arcs may have an included angle of about 15°.

Between the convex arcs 30 are concave arcs 33 which are preferably interconnected throughout their axial length at the respective tangent points of the convex and concave arcs. The radius of the arcs may vary depending on the mean diameter of the retention spring, type of plastic used to make the retention spring, its wall thickness, and the amount of friction force desired to be exerted by the retention spring against the roller cover to hold the roller cover in place on the roller cover support during use. However, in the form of the invention illustrated in the drawings, there are eight convex arcs 30 each preferably having a radius of between about 0.200 inch and about 0.300 inch and more preferably about 0.258 inch, and eight concave arcs 33 interconnecting the convex arcs each preferably having a radius of between about 0.300 inch and about 0.400 inch and more preferably about 0.328 inch.

Of course, the inside diameter of the roller cover must be less than the distance across the peaks 31 of the convex arcs 30 so that when the roller cover is forced over the retention spring, the convex arcs are resiliently deformed, exerting an outward force on the inside diameter of the roller cover at each peak to create the desired friction therebetween to hold the roller cover in place on the roller cover support during use. The core of the roller cover may also be slightly deformed as the roller cover is forced over the retention spring depending on the construction of the core.

The roller cover may be removed from the roller cover support either by pulling on the outboard end of the roller cover or by giving the handle portion 6 of the roller frame 4 facing in the outboard direction a quick rap on a rigid surface to cause the roller cover to release from the retention spring.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been disclosed with respect to only one embodiment, such feature may be combined with one or more other features as may be desired and advantageous for any given or particular application.

What is claimed is:

1. A roller cover support assembly comprising a roller cover support mountable for rotation on a roller frame shaft, and an annular retention spring coupled to the roller cover support, the retention spring including a plurality of axially extending circumferentially spaced resiliently deformable transversely convex arcs, the convex arcs having an axial length corresponding to a substantial majority of the axial length of the retention spring, the convex arcs having peaks engageable with an inner diameter of a roller cover when forced over the retention spring for frictionally retaining the roller cover on the roller cover support, wherein the peaks of the convex arcs have an axial length of substantially the same outer radius throughout a substantial majority of the length of the convex arcs for increasing the frictional contact between the peaks of the convex arcs and the inner diameter of the roller cover over the length of the peaks when the roller cover is forced over the retention spring, wherein the convex arcs have an axial length that is interconnected throughout their length by concave arcs between the convex arcs.

2. The support assembly of claim 1 wherein the peaks of the convex arcs have an axial length of between about 0.300 inch to about 0.400 inch.

3. The support assembly of claim 2 wherein the peaks of the convex arcs have an axial length of about 0.330 inch.

4. The support assembly of claim 1 wherein the convex arcs have inwardly tapered outboard ends for ease of forcing the roller cover over the retention spring.

5. The support assembly of claim 4 wherein the tapered outboard ends of the convex arcs have an axial length of about 0.100 inch to about 0.200 inch.

6. The support assembly of claim 4 wherein the tapered outboard ends of the convex arcs have an included angle of about 15°.

7. The support assembly of claim 1 wherein the convex and concave arcs are connected together at respective tangent points of the arcs.

8. The support assembly of claim 1 wherein the convex arcs have a radius of between about 0.200 inch and about 0.300 inch.

9. The support assembly of claim 1 wherein the concave arcs have a radius that is slightly greater than the radius of the convex arcs.

10. The support assembly of claim 9 wherein the concave arcs have a radius between about 0.300 inch and about 0.400 inch.

11. The support assembly of claim 1 wherein the retention spring has an overall length of about ½ inch.

12. The support assembly of claim 1 wherein the retention spring is made of plastic.

13. The support assembly of claim 1 wherein the roller cover support includes a pair of axially spaced annular surfaces adjacent an inboard end of the roller cover support between which the retention spring is captured.

14. The support assembly of claim 13 wherein the retention spring has an overall length somewhat less than the axial spacing between the annular surfaces allowing for some axial movement of the retention spring between the annular surfaces.

15. The support assembly of claim 1 further comprising a reduced diameter end portion at an inboard end of the roller cover support, and an inboard end cap attached to the reduced diameter end portion for trapping the retention spring between the inboard end cap and a larger diameter portion of the roller cover support adjacent the reduced diameter end portion.

16. The support assembly of claim 15 wherein the inboard end cap has an annular shoulder extending radially outwardly beyond the larger diameter portion of the roller cover support to provide a stop for locating the roller cover on the roller cover support when the roller cover is fully inserted thereon.

* * * * *